United States Patent [19]

Söderström

[11] Patent Number: 4,511,117

[45] Date of Patent: Apr. 16, 1985

[54] ACTIVATING APPARATUS IN A LIQUID CONVEYING SYSTEM OPERATED BY VACUUM, PREFERABLY A SO-CALLED VACUUM SEWAGE SYSTEM

[75] Inventor: Sigvard V. Söderström, Hägersten, Sweden

[73] Assignee: Aktiebolaget Electrolux, Stockholm, Sweden

[21] Appl. No.: 559,476

[22] Filed: Dec. 8, 1983

[30] Foreign Application Priority Data

Dec. 15, 1982 [SE] Sweden ..... 8207172

[51] Int. Cl.[3] ..... F15B 15/26; F16K 31/56

[52] U.S. Cl. ..... 251/73; 251/75; 92/25; 92/28; 92/84; 92/132; 92/94

[58] Field of Search ..... 4/249, 328, 361, 362, 4/405, 407, 408, 431, 434; 92/15, 132, 24, 25, 27, 28, 29, 84, 94; 251/73, 75; 91/446

[56] References Cited

U.S. PATENT DOCUMENTS

| | | | |
|---|---|---|---|
| 970,329 | 9/1910 | Heck | 92/28 |
| 2,811,137 | 10/1957 | Hartel | 92/29 |
| 3,321,194 | 5/1967 | Carlson | 92/84 |
| 3,482,267 | 12/1969 | Liljendahl | 4/431 |
| 4,134,421 | 1/1979 | Cameron | 251/73 |

FOREIGN PATENT DOCUMENTS

| | | | |
|---|---|---|---|
| 884606 | 7/1953 | Fed. Rep. of Germany | 92/84 |
| 1709090 | 5/1971 | Fed. Rep. of Germany . | |

*Primary Examiner*—Paul E. Maslousky
*Attorney, Agent, or Firm*—Alfred E. Miller

[57] ABSTRACT

An activating apparatus or device, for example for a valve in a liquid conveying system operated by means of a vacuum. The activating apparatus comprises a normally latched or locked operating device which by means of a spring, or the like, is connected to a force accumulator. The force accumulator is moved by the influence of vacuum and thereby tightens the spring which, when a lock arm disengages from the operating device, is released so that the operating device is moved, and thereby opens the valve.

2 Claims, 3 Drawing Figures

ACTIVATING APPARATUS IN A LIQUID CONVEYING SYSTEM OPERATED BY VACUUM, PREFERABLY A SO-CALLED VACUUM SEWAGE SYSTEM

This invention relates to an activating apparatus in a liquid conveying system operated by means of a vacuum, preferably a so-called vacuum sewage system.

Activating apparatus of the above type are used to open a normally closed valve in a system of conduits being subject to a vacuum. These valves can, for example, be mounted in toilets, or in the vicinity of other places where sewage is collected, in order to maintain in the necessary vacuum in the conduit system in their closed position, and separate it from the atmosphere. When these valves are in a open position, it is desireable for conveyance reasons to control the opening time of the valve as accurately as possible, so that a given quantity of liquid is followed by a given quantity of air having atmospheric pressure. Such a valve is for example described in Swedish Pat. No. 225,287. Generally, these valves are activated by the vacuum in the conduit system, the vacuum being transferred by a separate start valve to a piston or a diaphragm, which functions to lift the valve body from the valve seat. The use of vacuum-operated valves has the advantage that it is not necessary to have electric wires connected to the different sanitary installations. However, the disadvantages of the known valves are that the opening movement on some occasions is very slow and sometimes is not completed due to the fact that the vacuum available is too small. This, in turn, can depend on various conditions, for example the pressure increase caused when the valve is opened, or when several valves in the conduit system are open simultaneously, so that there will be a pressure increase in the whole system. Further, it is difficult to obtain an accurate setting of the opening time of these valves.

An object of the present invention is to provide an activating apparatus which eliminates the above-mentioned drawbacks. The purpose is achieved by the invention having an operating device movable between a first and second position, and a latching device which holds the operating device in said first position while a force accumulator is activated by a vacuum, and communication means between the force accumulator and operating device whereby when the latching device is released, the operating device is moved to said second position.

Figure 1:
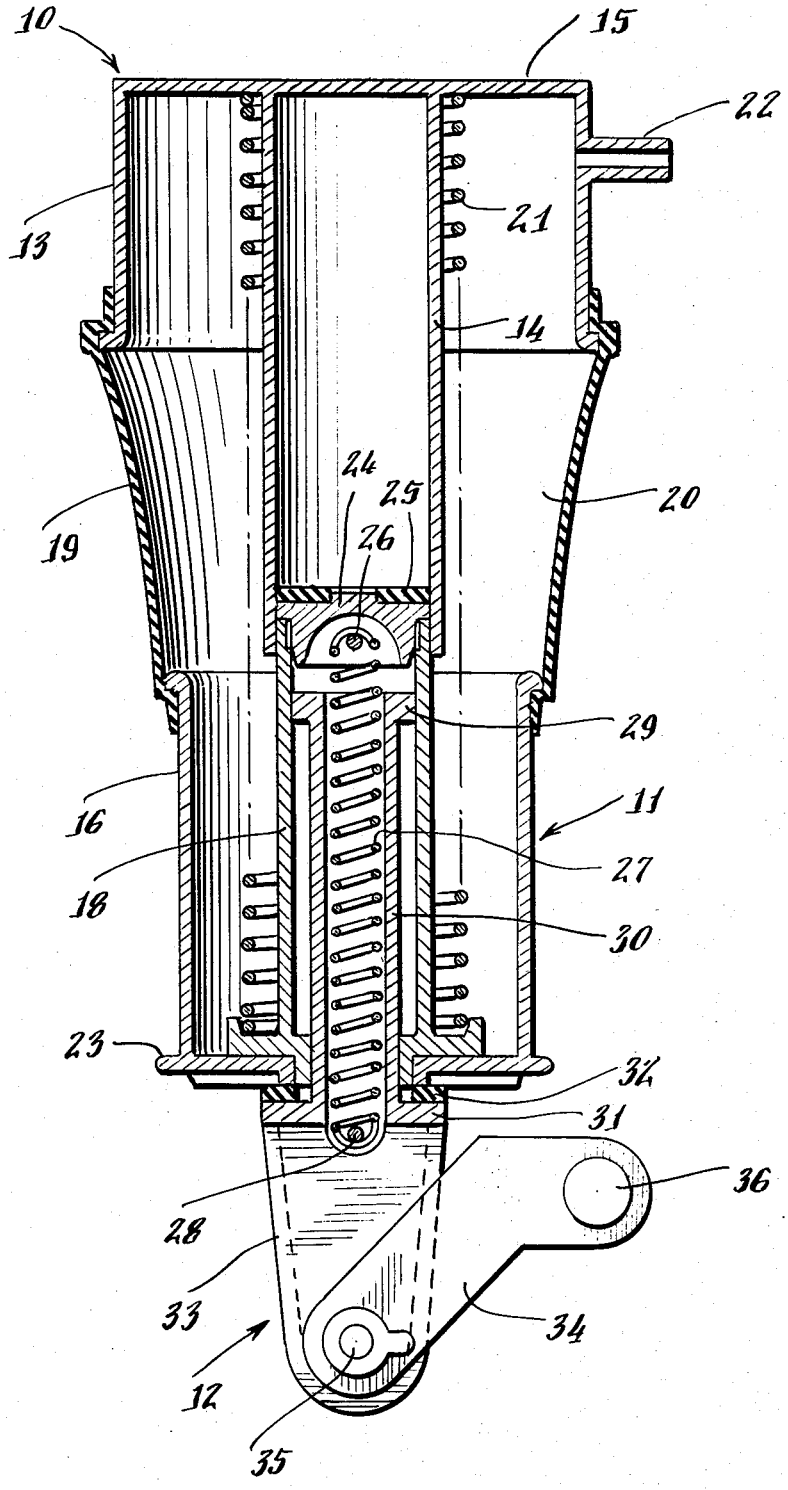

An embodiment of the invention will now be described with reference to the accompanying drawings in which FIG. 1 is a vertical section taken through the activating device in the normal position thereof.

Figure 2:
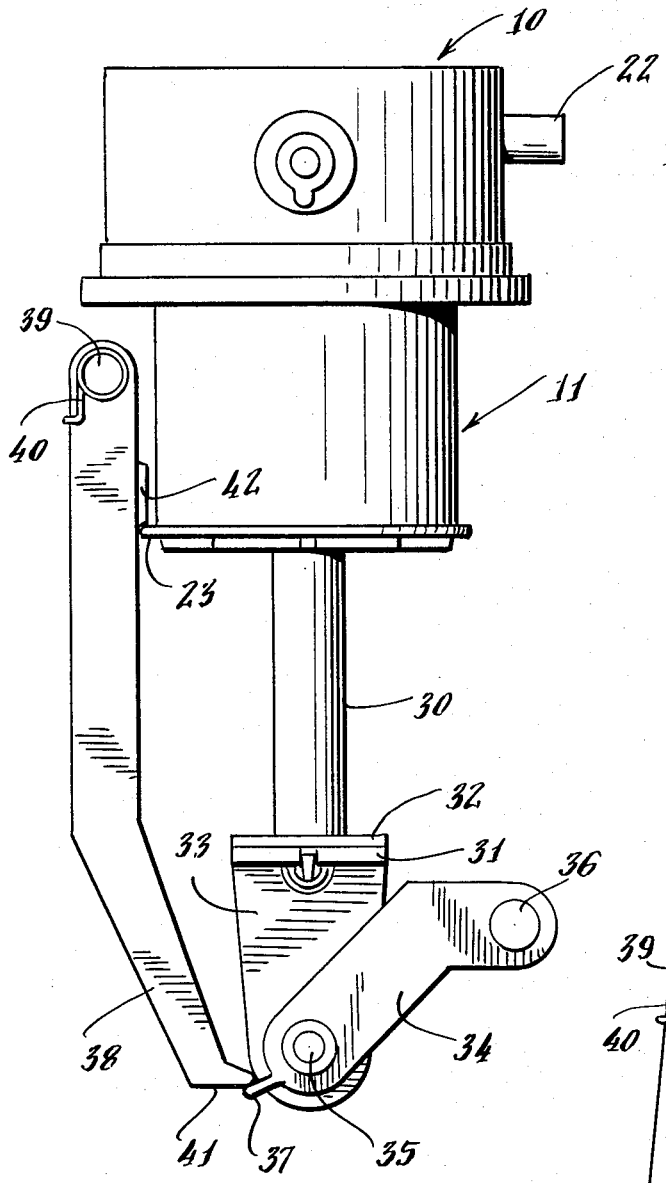
Figure 3:
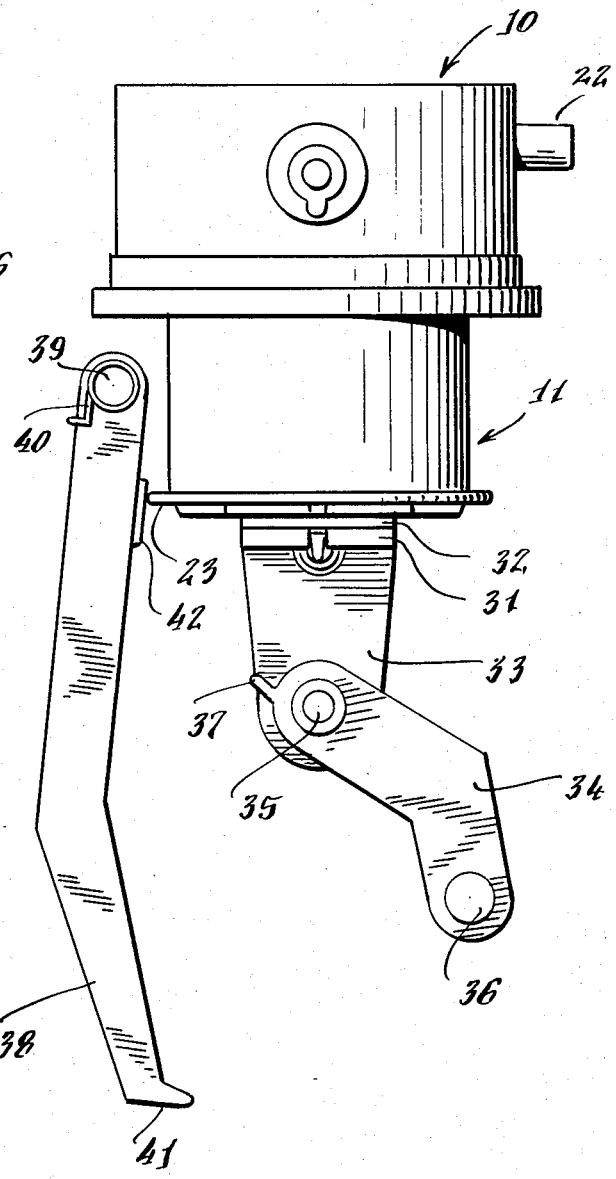

FIG. 2 is an elevational view in which the activating apparatus is partly activated, and FIG. 3 shows same view as FIG. 2, however with the activating apparatus in active position.

As seen in the Figures, the activating device or apparatus comprises three parts, i.e., a housing 10, a force accumulator 11 and an operating device 12, which are movable relative to one another. The housing 10 is fixed, for example, relative to a valve in a toilet, or the like. It has an outer cylindrical flange 13 and a central cylinder 14 which are connected by means of a bottom plate 15. The force accumulator comprises a cylindrical sleeve 16 connected through an annular plate 17 to a cylinder 18, which has an outer diameter equal to the inner diameter of the cylinder 14, so that the cylinder 18 can move in the cylinder 14. Between the flange 13 and the sleeve 16 is a rubber diaphragm 19, which is arranged in such a way that a closed chamber 20 is formed between the housing and the force accumulator.

In the chamber 20 is a compression spring 21 abutting the bottom plate 15 in the housing 10, as well as the annular plate 17 of the force accumulator 11. This spring tends to separate the housing and the force accumulator. A nipple 22 extends from the housing 10 and communicates through a hose and a start valve with a conduit system (not shown), which is under a vacuum. Exteriorly, the force accumulator 11 has also a bead 23, whose function will be explained hereinafter.

At the upper end of the cylinder 18 is a plug 24 which serves as a seal. At its upper side this plug has a rubber cushion 25 serving as an impact surface, and at its underside is provided with an attachment member 26 for one end of a tension spring 27, whose other end is attached to an attachment member 28 in the operating device 12.

The operating device 12 comprises a slide block 29 moving within the cylinder 18 and is connected to a hollow pull rod 30 enclosing the tension spring 27. In its bottom end the pull rod 30 has a flange 31 supporting a rubber cushion 32. The flange 31 is connected to a lug 33 in which an arm 34 is pivotally journalled by means of a shaft 35. The other end of the arm 34 is pivotally fastened to a shaft 36 connected to a valve (not shown) in the conduit system in order to open and close the valve respectively. Furthermore, near the shaft 35 the arm 34 has a projection 37, as seen in FIGS. 2 and 3 for engagement with a lock or latching arm 38. The latter is pivotally arranged on a shaft 39, which is fixed relative toward the housing 10. The lock arm is acted upon by a spring 40 in the direction to the lug 33, and its lower part is shaped as a finger 41 abutting the projection 37. In its upper part the lock arm has a cam surface 42 for co-action with the above-mentioned bead 23.

The apparatus operates in the following manner. Vacuum is supplied by the start valve into the chamber 20 which causes the force accumulator 11 to rise resulting in compression and expansion respectively of the springs 21 and 27. During this movement the operating device 12 is in its lower position and locked by the lock arm 38. When the force accumulator has reached the position shown in FIG. 2, the bead 23 acts on the cam surface 42 such that the lock arm will move to the left in the Figure and the finger 41 will disengage from the projection 37 and the operating device 12 be released. Thus, the operating device 12 will move rapidly upwards under the action of the tension spring 27 and the valve will open by the action of the arm 34 and the shaft 36.

When air of atmospheric pressure is thereafter supplied to the chamber 20 the force accumulator 11 and the operating device return to the initial positions in which the operating device is again locked by the lock arm 28.

Should sufficient negative pressure not be reached in the chamber 20, the result would merely be that the force accumulator 11 moves upwards while the operating device 12 remains in its locked position.

It is possible within the scope of the invention to establish a direct connection between the chamber 20 and the conduit system by the aid of a non-return valve, so that the maximum vacuum available during a given period of time is retained in the chamber 20, thereby keeping the force accumulator 11 active until the valve is opened. In that case, the locking action shown in the Figures is replaced by a locking means which is not operated by the movement of the force accumulator. Instead, the locking means can be acted upon mechanically by the start valve.

I claim:

1. In an actuating apparatus for a liquid conveying system operated by means of a vacuum, such as a vacuum sewage system having a valve, the improvement comprising: an operating device for said valve movable between a first and second position, a housing, a chamber, a force accumulator which is movable with respect to said housing, the housing and the force accumulator forming parts of said chamber which is connected to the vacuum of said system and is contractable under the influence of the vacuum in said chamber, means being coupled between said operating device and said force accumulator, a latching member coacting with said operating device by retaining the latter in said first position, while said force accumulator initially is actuated by means of the vacuum, said force accumulator being operatively connected to said operating device in such a manner that when said latching member is released, the operating device is moved to said second position by said means, said operating device being provided with a movable arm having a projection at a free end, said latching member being in the form of a second arm, said projection being latched by means of a spring biasing said second arm into engagement therewith, and said second arm during the movement of said force accumulator being acted upon by said force accumulator whereby said projection is released from said second arm and the operating device moves to the second position to cause said valve to operate.

2. An actuating apparatus as claimed in claim 1 further comprising diaphragm being fastened to said housing and the force accumulator, said means comprising a tension spring, and said force accumulator being provided with a compression spring.

* * * * *